United States Patent [19]

Klee

[11] 4,229,947

[45] Oct. 28, 1980

[54] CRYOGENIC FREEZER

[75] Inventor: David J. Klee, Emmaus, Pa.

[73] Assignee: Air Products and Chemicals, Inc., Allentown, Pa.

[21] Appl. No.: 64,234

[22] Filed: Aug. 6, 1979

[51] Int. Cl.[3] ..... F25D 17/02

[52] U.S. Cl. ..... 62/374; 62/380

[58] Field of Search ..... 62/63, 374, 380

[56] References Cited

U.S. PATENT DOCUMENTS

| | | | |
|---|---|---|---|
| 3,403,527 | 10/1968 | Berreth et al. | 62/380 |
| 3,553,973 | 1/1971 | Moran | 62/380 |
| 3,600,901 | 8/1971 | Wagner | 62/380 |
| 3,611,745 | 10/1971 | Schlemmer | 62/374 |
| 3,672,181 | 6/1972 | Tyree, Jr. | 62/380 |
| 3,708,995 | 1/1973 | Berg | 62/374 |
| 3,813,895 | 6/1974 | Klee et al. | 62/374 |
| 3,818,719 | 6/1974 | Banike | 62/374 |
| 3,824,806 | 7/1974 | Wagner | 62/380 |
| 3,892,104 | 7/1975 | Klee et al. | 62/380 |
| 4,086,784 | 5/1978 | Wagner | 62/374 |

*Primary Examiner*—Ronald C. Capossela

*Attorney, Agent, or Firm*—Ronald B. Sherer; E. Eugene Innis

[57] ABSTRACT

A cryogenic freezer of the elongated, tunnel-type is disclosed in which a centrally located blower recirculates injected cryogenic refrigerant at extremely high velocities through a pair of minimum size product contact chambers. In one preferred embodiment, the cross-sectional area of the product contact chamber is variable so as to maintain minimum sizes for products of different height.

12 Claims, 4 Drawing Figures

FIG. 2
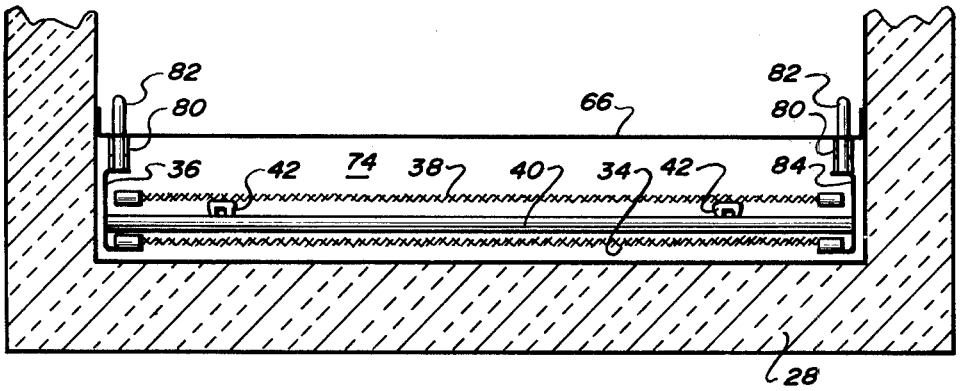
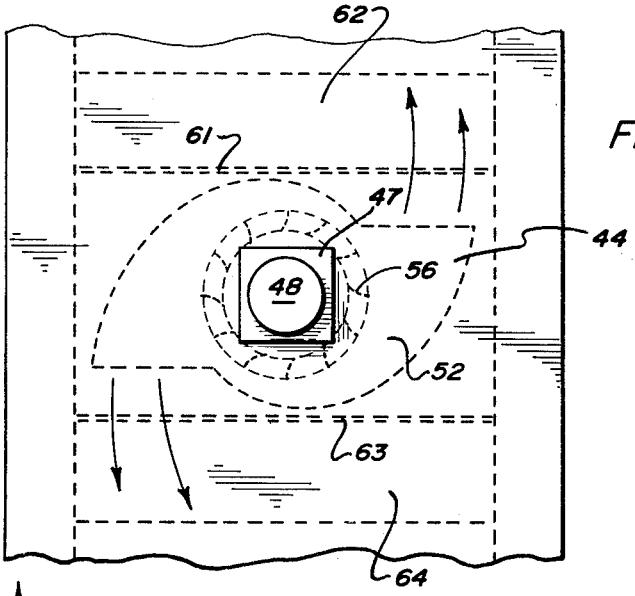
FIG. 3
FIG. 4
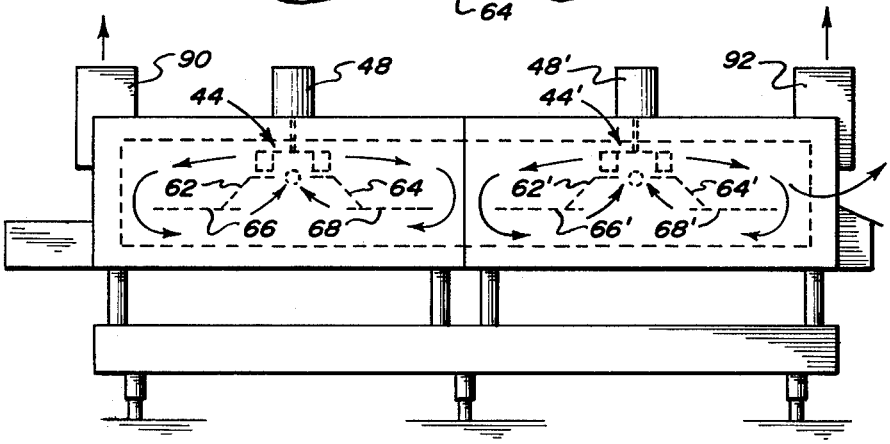

CRYOGENIC FREEZER

BACKGROUND OF THE INVENTION

Many forms of cryogenic freezers have been designed for the use of such cryogenic refrigerants as liquid nitrogen and liquid carbon dioxide. Since liquid nitrogen remains in liquid phase during expansion through a nozzle into the freezer, and thereafter vaporizes into cold gas upon contact with the relatively warm product, it is common to utilize a spray header and a plurality of gaseous pre-cooling zones as disclosed in U.S. Pat. No. RE 28,712, U.S. Pat. Nos. 3,403,527, and 3,813,895. Alternatively, some freezers such as disclosed in U.S. Pat. No. 3,611,745 have employed indirect heat exchange of the liquid nitrogen with the product, and have circulated the vaporized nitrogen gas as a protective atmosphere in large volume freezing chambers using a plurality of circulating fans.

In the case of liquid carbon dioxide, the expansion of the liquid refrigerant through the injection nozzle causes the liquid to vaporize into a mixture of gas and solid particles. Some prior freezers, such as that disclosed in U.S. Pat. No. 4,086,784, spray the carbon dioxide snow directly on the product and circulate the gas with a plurality of axial flow fans. Other freezers, such as that disclosed in U.S. Pat. No. 3,818,719, inject the cryogenic refrigerant into the discharge of a blower and circulate the gas with plurality of fans. However, these designs require the movement of large volumes of gas which requires significant amounts of fan energy. This results in significant amounts of undesirable heat input into the freezer.

Other freezer designs, such as disclosed in U.S. Pat. Nos. 3,672,181, 3,677,167 and 3,708,995 have ulilized other arrangements of fans and blowers to circulate mixtures of gaseous and solid carbon dioxide in contact with products to be frozen. However, the velocities of the gas-solid mixtures have been relatively low, and a plurality of fans or blowers are required to circulate the large volumes of the refrigerant mixture which results in an undesirable heat input to the freezer. Also, problems have been encountered with the build-up of carbon dioxide snow such that the freezers must be operated at temperatures significantly warmer than the sublimation temperature of the $CO_2$.

SUMMARY OF THE INVENTION

The present invention provides a cryogenic freezer utilizing a single, centrally located blower which circulates the cryogenic refrigerant through a pair of high velocity, minimum size product contact chambers. The product contact chambers, which may be of variable cross-section, are of minimum cross-section so as to reduce the amount of refrigerant gas which is circulated, and maximize the velocity of the refrigerant so as to substantially increase the rate of heat transfer to the product being frozen. In addition, the preferred embodiment of the present invention injects the cryogenic refrigerant into the center of the centrifugal blower, and provides a pair of plenum chambers through which the refrigerant flows at relatively lower velocity before flowing above and below the product in the high velocity product contact chambers.

BRIEF DESCRIPTION OF THE DRAWINGS

FIG. 2 is an enlarged sectional view showing one of the product contact chambers taken along view line 2—2 of FIG. 1;

FIG. 3 is a top view of the center portion of the freezer taken along view line 3—3 of FIG. 1; and FIG. 4 is a simplified, side view of a higher production rate freezer composed of multiple freezers each of which is as individually shown in FIG. 1.

DETAILED DESCRIPTION

Figure 1:
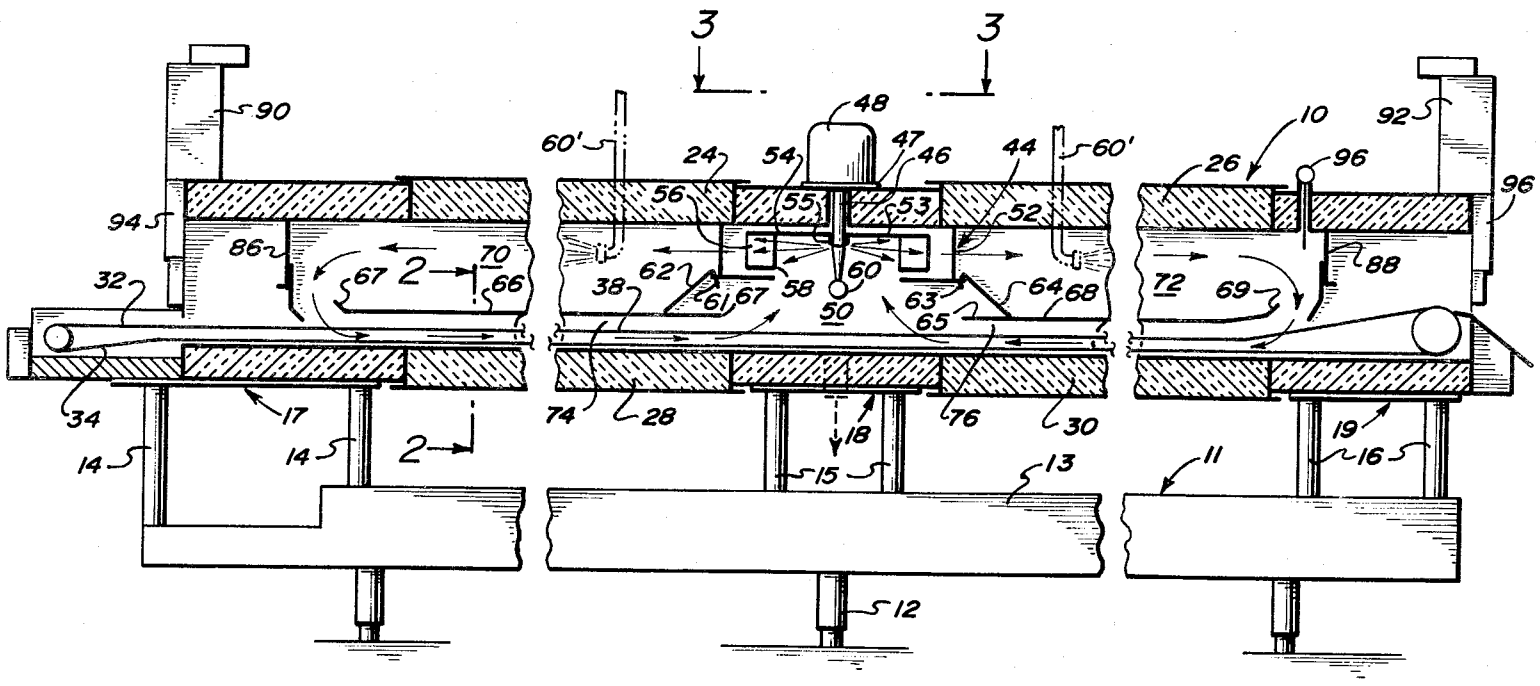
FIG. 1 is a simplified, side elevational view showing the freezer in cross-section with mid-portions of the freezer broken away to reduce the horizontal length of the tunnel.

Referring to FIG. 1, the overall freezer includes an elongated, horizontally extending tunnel 10, preferably composed of stationary and movable sections, which is supported by a general frame assembly 11. For example, the frame assembly may include legs 12, a main frame 13, and three sets of vertical frame members 14, 15 and 16. Vertical frame members 14, 15 and 16 respectively support the stationary inlet section 17, the stationary center section 18, and the stationary outlet section 19. Each of these stationary sections of the tunnel include insulated bottom, top and side walls, and the stationary sections are relatively short; such as for example, 1 or 2 feet in horizontal length. The major portion of the length of the insulated tunnel is formed by movable covers 24–26, and movable bottom sections 28–30 which extend horizontally between the stationary sections. The preferred overall length of the tunnel is in the range of 15 to 25 feet, and the optimum is in the order of 20 feet. The details of the mounting of the movable covers 24–26, and the movable bottom sections 28–30, form no portion of the present invention and may be of any suitable design such as that disclosed in U.S. Pat. No. 3,813,895.

The products to be frozen are conveyed through the insulated tunnel from inlet section 17 to the discharge section 19 by means of a porous, wire mesh conveyor belt 32. As shown more clearly in FIG. 2, the lower reach 34 of conveyor belt 32 is supported by channel brackets 36 and is spaced from the bottom of the tunnel by the minimum amount of running clearance which is required. For example, the spacing between the bottom tunnel sections 28–30 and the lower reach 34 of the conveyor belt is less than 1 inch, and preferably less than ½ inch. The upper reach 38 of conveyor 32 is supported as closely as possible to the lower reach such as by support bars 40 and low friction strips 42. For example, the spacing between the upper and lower reaches should be less than 2 inches, and preferably in the order of 1.5 inches or less. Therefore, the distance between the upper reach 38 and the bottom of the tunnel is less than 3 inches, and preferable in the order of 2 inches.

As shown most clearly in FIGS. 1 and 3, the stationary center section 18 includes a single blower 44 which is driven by a suitable motor 48. Blower 44 is of the centrifugal type having a center inlet 50 and two peripheral discharge outlets formed by a double discharge scroll 52. Blower 44 includes a rotor 53 comprising a circular plate 54 secured by hub 55 to vertical drive shaft 46, and a plurality of circumferentially arranged blades 56. The lower edges of blades 56 are preferably secured to an annular ring 58. It will be noted that the entire internal diameter of rotor 53 is open and unobstructed. This design enables the direct injection of liquid carbon dioxide into the center of the rotor through injection nozzle 60, and also eliminates the problem of accumulation of frost in the blower. That is, there is no inlet blower structure upon which either frost from the product or the solid carbon dioxide can adhere, and the force of the expansion of the liquid carbon dioxide to the gaseous state blasts any accumulated frost or solid carbon dioxide from the scroll and rotor blades. It will also be noted that hub 55 acts as a deflecting distributor against which the injected stream of carbon dioxide impinges and is dispersed evenly and radially outwardly to the rotor blades.

As shown most clearly in FIG. 1, a pair of hinged plates 62–64 are pivotally secured at 61 and 63 to the lower portion of discharge scroll 52 and extend outwardly and downwardly from the scroll so that their lower edges rest upon horizontally extending baffles 66 and 68, respectively. The baffles 66 and 68 extend across the width of the tunnel, and along the length of the tunnel from the center portion to the opposite ends comprising the inlet and outlet sections 17 and 19, respectively. Thus, horizontal baffles 66 and 68 divide the tunnel into upper plenum chambers 70–72, and lower product contact chambers 74–76 through which the products are carried on the upper reach of conveyor belt 32. It will be noted that the cross-sectional area of plenum chambers 70–72 is much greater than that of the product chambers, and preferably by a factor of at two or three times.

As more clearly shown in FIG. 2, baffles 66 and 68 are preferably supported so as to be vertically adjustable and thereby minimize the cross-sectional area of the product contact chambers 74 and 76 regardless of the change in sizes of the products being frozen. Various means may be utilized to support the vertically adjustable baffles 66 and 68. For example, a plurality of stacked spacers 80 may be added or removed from vertical support pins 82, the latter of which are supported by channel members 36. It will be apparent that, as the baffles 66 and 68 are raised or lowered for products of different height, hinged plates 62–64 automatically pivot upwardly or downwardly with their lower edges remaining in contact with baffles 66, 68 so as to maintain a seal between the discharge of the blower and its inlet region 50.

In the inlet and outlet sections 17 and 19, there are provided a pair of vertically adjustable, flow-reversing baffles 86 and 88 which cooperate with the edges 67 and 69 of baffles 66 and 68 to form flow reversing passages. As shown by the flow arrows, these reversing passages direct the refrigerant at the ends of plenum chambers 70 and 72 to flow back to the center of the tunnel through the product contact chambers 74 and 76. Since the conveyor is quite porous, such as of open mesh design, approximately one-half of the high velocity refrigerant flows through the upper reach of the belt at reversing baffles 86 and 88, and flows between the upper and lower reaches of the conveyor in high velocity contact with the underneath side of the product being frozen in the product contact chambers. Thus, the cold refrigerant flows back to inlet 50 of center blower 44 through the minimum sized product contact chambers 74 and 76 at maximum velocity while the product is exposed to the high velocity refrigerant on all sides.

A temperature sensor 96 is located in the tunnel so as to measure the temperature of the refrigerant in the freezer, such as in plenum chamber 72, and the temperature sensor is connected through a conventional control system so as to inject liquid carbon dioxide through nozzle 60 when the temperature in the tunnel rises above a pre-set temperature such as slightly above or below minus 109° F. Whenever liquid $CO_2$ is injected, the volume of the resulting gaseous and solid $CO_2$ refrigerant in the freezer increases such that an equal volume of refrigerant flows under adjustable baffles 86 and 88 to the product inlet and outlet openings of the tunnel. This excess refrigerant is removed through suction exhaust blowers 90–92 which are connected to the product inlet and outlet openings by suction ducts 94–96.

In operation, the height of divider baffles 66 and 68 is set so as to accomodate the size of the product with the least amount of necessary clearance. For example, the horizontally extending divider baffles 66 and 68 are set so as to allow one inch or less of clearance space above the height of the particular product to be frozen. This results in a minimum cross-sectional area in the product contact chambers 74 and 76 which, in turn, results in the recirculation of the minimum pounds of refrigerant and the maximum velocity through the product contact chambers. The high velocity refrigerant flows over the product on the upper reach of the conveyor, as well as, through the upper reach of the porous conveyor so that the high velocity refrigerant is also in direct contact with the underneath side of the product in chambers 74 and 76. By virtue of the small cross-sectional area of the product contact chambers, refrigerant velocities in the order of 1,500 to 2,000 feet/minute have been achieved, and such velocities are only limited by the type of product which would be blown along the conveyor by higher velocities. At the same time, the velocity of the refrigerant returning to the inlet 50 of blower 44 is sharply reduced by virtue of the large cross-sectional flow area provided at the inlet region 50 of blower 44. This large cross-sectional flow area is provided by edges 65 and 67 of baffles 66 and 68 which are separated by a distance at least twice, and preferably four times, the combined vertical height of product contact chambers 74 and 76. Thus, small products such as hamburger patties have been rapidly frozen with refrigerant velocities in the order of 2,000 feet/minute in contact passages 74 and 76 without being raised off the conveyer belt by the refrigerant returning to the inlet of the blower.

Whenever temperature sensor 96 actuates the injection of additional liquid carbon dioxide through nozzle 60, the rapid expansion of the liquid carbon dioxide produces a mixture of cold gas and small solid carbon dioxide particles, and this refrigerant mixture is blown in opposite directions through plenum chambers 70 and 72 by blower 44. If the tunnel temperature is pre-set above the sublimation temperature of minus 109° F., most of the solid carbon dioxide particles sublime to the gaseous state during passage through plenum chambers 70 and 72 such that the product is contacted by a substantially all-gaseous refrigerant. However, at lower temperatures, the product may be contacted by the refrigerant in the form of a mixture of gaseous and solid carbon dioxide particles. In either event, the buildup of frost on the rotor blades is prevented, even at relatively warm idle conditions of 0° F., by the direct injection into the center of the blower rotor 53 which removes any accumulated frost. In addition, the build-up of frost or solid carbon dioxide in the product contact chambers 74 and 76 is also prevented by the extremely high velocities which maintain the solid particles suspended in the gas flow stream. Therefore, while it is preferred to locate nozzle 60 at the blower inlet 50, it will be apparent that additional or replacement nozzles 60' may be positioned in one or both of plenum chambers 70 and 72, as shown in phantom line, and that refrigerants such as liquid nitrogen may be utilized as well as liquid carbon dioxide.

From the foregoing description it will be apparent that the present freezer minimizes the volume of recirculated gas and reduces the number of required blowers such that the fan energy and resultant heat input is minimized. At the same time, the velocity of the refrigerant in contact with the product is maximized, and the problems of frost and snow accumulation are eliminated both at warm idle conditions and when the freezer is operated below the sublimation temperature of carbon dioxide. It will also be apparent that the variable height feature of baffles 66 and 68 contributes to minimizing the cross-sectional area of the high velocity product contact chambers in those installations where the same freezer must be used to freeze different sized products such as thin pies and thick cakes. However, the principles of the invention regarding the use of plenum chambers and smaller sized product contact chambers is equally applicable where only one size of product is frozen. In that case, the divider baffles 66 and 68 may be permanently set for the minimum required clearance and are not varied. While FIG. 1 illustrates divider baffles 66–68 as being two separate baffles, which is preferred for ease of handling, it will be apparent that the two baffles could be made as a single piece with the provision of one or more suitably large holes in the region of blower inlet 50. In addition, it will be apparent that a baffle, or other type of solid conveyor support, could be utilized in place of or in conjunction with support rods 40 such that the lower reach of the conveyor would be separated from the product contact chambers. This would further reduce the cross-sectional area of the product contact chambers 74–76 by a slight amount, but is not preferred because of the additional problems in cleaning the lower portion of the freezer.

As described hereinabove, the total freezer requires only a single blower for freezer lengths in the range of 15 to 25. While freezers of this length, such as 20 feet, are entirely adequate to meet the production rates of many commercial freezing operations, it will be apparent that the production rate in pounds of food products frozen per hour may be substantially doubled, tripled or quadrupled by simply connecting multiple freezers in series as shown in FIG. 4. Therefore, the term "single blower" is intended to mean that there is only one blower per minimum conveyor belt length of 15 feet, and preferably, only one blower per 15 to 25 feet of conveyor belt length. Of course, for extra wide freezers, two or more blowers may be arranged across the width of the belt, but there is only a single blower along the above indicated minimum lengths of the belt. Since prior freezers have commonly utilized one fan or blower for each 3 to 6 feet of belt length, it will be apparent that the present invention substantially reduces the number of blowers per foot of total conveyor belt length, and positions the lesser number of blowers in substantially the mid-portion of each 15 to 25 foot length of freezer or freezer section.

Lastly, it will also be apparent that other modifications may be made within the scope of the invention, such as exhausting some or all of the excess refrigerant through a centrally located discharge conduit 98 at which point the temperature of the refrigerant is slightly warmer that at the reversing control baffles 86 and 88. Therefore, it is to be understood that: many variations and equivalents will be apparent to those skilled in the art; that the foregoing description is purely illustrative of the invention and the best known modes of practice thereof; and that the true scope of the invention is not intended to be limited other than as set forth in the following claims.

What is claimed is:

1. A cryogenic freezer comprising:

(a) at least one elongated, thermally insulated tunnel section having a product inlet and a product outlet spaced apart by at least 15 feet;

(b) horizontally disposed divider baffle means extending substantially throughout said tunnel section between said inlet and said outlet for dividing said tunnel into a pair of elongated upper plenum chambers and a pair of elongated lower product contact chambers;

(c) a single blower mounted in substantially the mid-portion of said tunnel, said blower having discharge passage means connected to said plenum chambers and inlet passage means connected to said product contact chambers;

(d) a porous conveyor belt having at least the upper reach thereof extending through said product contact chambers, means supporting said upper reach so as to form refrigerant flow paths extending above and below said reach within said product contact chambers;

(e) flow reversing passage means connecting said plenum chambers to said product contact chambers adjacent the inlet and outlet portions of said tunnel section for passing refrigerant from said plenum chambers to and through said product contact chambers and back to said blower inlet passage means to form two high velocity refrigerant recirculation paths; and (f) cryogenic refrigerant injection means for directly injecting a cryogenic refrigerant in the liquid or gas/solid phase into at least one of said recirculation paths.

2. The cryogenic freezer as claimed in claim 1 in which said horizontally disposed divider baffle means is positioned so as to define the cross-sectional area of said product contact chambers substantially less than the cross-sectional area of said plenum chambers.

3. The cryogenic freezer as claimed in claim 2 in which the cross-sectional area of said product contact chambers is in the order of one-half or less than the cross-sectional area of said plenum chambers.

4. The cryogenic freezer as claimed in claim 1 in which said horizontally disposed divider baffle means are vertically adjustable, and means for setting the height of said vertically adjustable divider baffle means for the minimum clearance of products of various sizes.

5. The cryogenic freezer as claimed in claim 4 in which said blower discharge passages include pivoted plates having their non-pivoted edges engaging said vertically adjustable divider baffle means.

6. The cryogenic freezer as claimed in claim 1 in which said cryogenic refrigerant injection means is positioned for injecting the cryogenic refrigerant directly into the inlet of said blower.

7. The cryogenic freezer as claimed in claim 1 in which said single blower comprises a centrifugal blower having a vertical axis of rotation and a pair of horizontally disposed discharge passages; said blower inlet passage extending vertically downwardly through said divider baffle means to said product contact chambers.

8. The cryogenic freezer as claimed in claim 7 in which said blower includes a bladed rotor having an inlet, and said rotor inlet is open and unobstructed across the entire internal diameter of said rotor.

9. The cryogenic freezer as claimed in claim 8 in which said blower rotor includes a refrigerant dispersing deflector means within said rotor, and said refrigerant injection means is positioned to direct the injected refrigerant against said refrigerant dispersing deflector means for directing said refrigerant radially outwardly from said axis of rotation.

10. The cryogenic freezer as claimed in claim 1 wherein said divider baffle means comprise first and second horizontally extending baffles having spaced edges at the mid-portion of said tunnel, and said spaced edges define the cross-sectional area of said blower inlet passage means.

11. The cryogenic freezer as claimed in claim 10 wherein the cross-sectional area defined by said divider baffle edges is at least twice the cross-sectional area of the combined cross-sectional areas of said product contact chambers.

12. The cryogenic freezer as claimed in claim 1 including refrigerant discharge means located in the mid-portion of said tunnel in communication with said product contact chambers.

* * * * *